United States Patent [19]

Danckert et al.

[11] 4,219,002

[45] Aug. 26, 1980

[54] SOUND INSULATED INTERNAL COMBUSTION ENGINE

[75] Inventors: Hermann Danckert; Michael Willmann, both of Wolfsburg, Fed. Rep. of Germany

[73] Assignee: Volkswagenwerk Aktiengesellschaft, Wolfsburg, Fed. Rep. of Germany

[21] Appl. No.: 952,445

[22] Filed: Oct. 18, 1978

[30] Foreign Application Priority Data

Oct. 18, 1977 [DE] Fed. Rep. of Germany ..... 2746740

[51] Int. Cl.[3] ..... F02B 77/00

[52] U.S. Cl. ..... 123/198 E; 123/195 C; 181/204

[58] Field of Search ..... 123/198 E, 195 C, 195 S; 181/204

[56] References Cited

U.S. PATENT DOCUMENTS

| | | | |
|---|---|---|---|
| 3,464,398 | 9/1969 | Scheiterlein et al. | 181/204 |
| 3,540,425 | 11/1970 | Scheiterlein et al. | 181/204 |
| 3,684,053 | 8/1972 | Fachbach et al. | 123/198 E |
| 4,071,008 | 1/1978 | Skatsche et al. | 123/198 E |
| 4,077,383 | 3/1978 | Hatz | 123/198 E |

*Primary Examiner*—Ira S. Lazarus

*Attorney, Agent, or Firm*—Spencer & Kaye

[57] ABSTRACT

An internal combustion engine includes an engine block and an oil pan sealingly secured to one another along substantially horizontally extending mounting faces to constitute a unit and a sound-insulating capsule shrouding the engine block and having a lower terminal zone. A sound dampening mounting arrangement is provided for attaching the lower terminal zone of the capsule to the unit at the height level of the mounting faces.

6 Claims, 2 Drawing Figures

SOUND INSULATED INTERNAL COMBUSTION ENGINE

BACKGROUND OF THE INVENTION

This invention relates to an internal combustion engine encapsulated in a soundproof manner, particularly for use in automotive vehicles. The engine has an oil pan which is sealingly secured to the engine block along substantially horizontal mounting faces.

An internal combustion engine of the above-outlined type is known and disclosed, for example, in German Laid-Open Application (Offenlegungsschrift) No. 2,403,254. In the arrangement described therein the capsule is open downwardly and thus the oil pan of the engine projects beyond the capsule through the opening into the path of the air stream generated by the motion of the vehicle. An encapsulation designed in this manner is advantageous regarding the cooling of the oil pan and its contents; such an advantage is, however, acquired by introducing a serious drawback, namely a downward escape of a substantial proportion of the sound energy emanating from the internal combustion engine.

Further, as disclosed, for example, in German Laid-Open Application (Offenlegungschrift) No. 2,411,490, sound insulated, encapsulated internal combustion engines are known which do not have the above-discussed disadvantage since underneath the internal combustion engine there is provide a lid-like component forming part of the capsule. Such structures, however, have the disadvantage that a separate additional air flow within the capsule has to be provided to ensure the required cooling of the oil.

SUMMARY OF THE INVENTION

It is an object of the invention to provide an improved internal combustion engine encapsulated in a soundproof manner which can be readily installed, thus permitting an attachment of the oil pan to, and its removal from the capsule proper without separate mounting means and which presents an optimum acoustic solution; all these advantages are to be achieved without additional structural expense.

These objects and others to become apparent as the specification progresses, are accomplished by the invention, according to which, briefly stated, a lower terminal zone of the capsule is, at the height level of the mounting faces of the oil pan, secured to the engine block or to the oil pan (soundproofed with respect to the engine block) or both.

Thus, in the internal combustion engine according to the invention, the sound insulating capsule is also closed downwardly by providing that a lower terminal zone of the capsule is connected in a soundproof manner with the structural unit constituted by the engine block and the oil pan. Accordingly, no introduction of sound energy from the internal combustion engine proper into the capsule takes place and further, by virtue of the location of connection between the capsule and the internal combustion engine, that is, in the zone of the mounting faces between the oil pan and the engine block it is ensured that the oil pan is situated externally of the capsule in the cooling air stream and also, the means for mounting the oil pan to the engine block are accessible for assembly or disassembly. Since the space surrounded by the capsule is maintained oil-free because of a proper seal between the engine block, the oil pan and the lower end zone of the capsule, the latter may accommodate additional components of the internal combustion engine which are to be driven in a conventional manner by drive belts from the crank shaft of the engine. In case of a so-called wet capsule which is a high-walled crank case, it is necessary—and this constitutes a disadvantage—to provide complex shaft seals which permit relative displacements between the capsule, on the one hand, and the shafts or the like oscillating with the the internal combustion engine, on the other hand.

The invention can be realized in a simple manner by providing that the securing means which serve for attaching the oil pan to the engine block are, at the same time, used for securing the lower terminal zone of the capsule with the structural unit constituted by the engine block and the oil pan.

DESCRIPTION OF THE PREFERRED EMBODIMENTS

Figure 1:
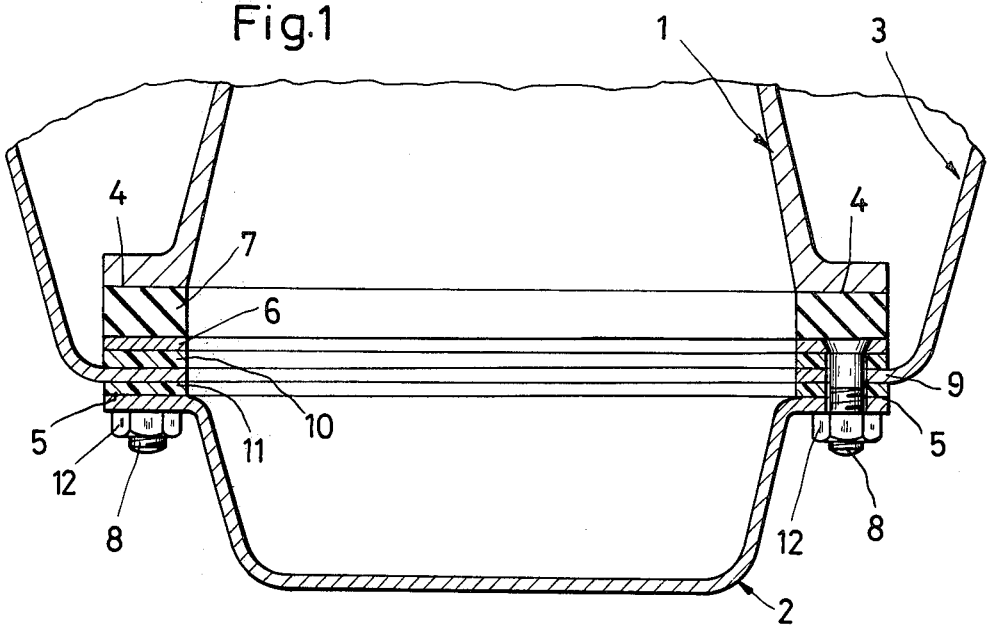
FIG. 1 is a sectional elevational view of a preferred embodiment of the invention.

Turning now to FIG. 1, there is shown the lower part of an engine block 1, an oil pan 2 arranged therebelow as well as the lower part of an engine capsule 3 which, as a rule, extends upwardly and is closed at the top by a lid member.

The engine block 1 has lower horizontal mounting faces 4, while the oil pan 2 has upper mounting faces 5 which, as a rule, have a closed circumferential course. A rigid metal carrier ring 6 is interposed between the mounting faces 4 and 5, and is soundproofed by a sound dampening intermediate layer 7 with respect to the engine block 1. The carrier ring 6 and the mounting face 4 of the engine block 1 are glued or vulcanized to opposite sides of the layer 7. Thus the connection between parts 1 and 6 is void of sound transmitting components. In this manner both the capsule 3 and the oil pan 2 are soundproofed with respect to the engine block 1.

From the carrier ring 6 there extend downwardly the required number of threaded securing bolts 8 which project through aligned holes provided in the inwardly bent lower terminal flange 9 of the capsule 3 and in the oil pan 2. Further, the bolts 8 project through openings in gaskets 10 and 11 arranged on opposite sides of the capsule flange 9.

It will be understood that the lower terminal portion of the capsule 3 may be secured to the structural unit constituted by the engine block 1 and the oil pan 2 of the internal combustion engine in other ways. The embodiment illustrated in FIG. 1 is, however, particularly advantageous, since the securing bolts 8 which are required in any event for securing the oil pan 2 to the engine block 1 may, together with the nuts 12, simultaneously serve as the connecting means between the assembly formed by the components 1 and 2 of the internal combustion engine and the capsule 3. The capsule 3 is of such dimension that it is capable to accommodate additional components. In principle, however, drive shafts or the like for operating such additional components may be passed without difficulty through the capsule 3 since no seals or baffle plates for soundproofing are necessary.

Figure 2:
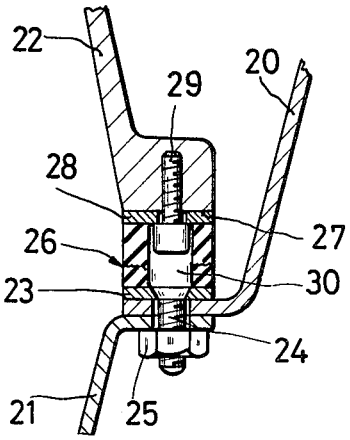
FIG. 2 is a sectional elevational view of another preferred embodiment of the invention.

Turning now to FIG. 2, there is shown another embodiment for securing a sound insulating capsule 20 and an oil pan 21 to an engine block 22 of an internal combustion engine. FIG. 2 shows only that part of the structure which corresponds to the right-hand side of FIG. 1.

The structure according to FIG. 2 comprises a carrier ring 23 (corresponding to component 6 of FIG. 1) from which project spaced, downwardly oriented threaded securing bolts 24. They pass through aligned openings in the capsule 20 and the oil pan 21 and are threadedly engaged by respective nuts 25. A sound dampening intermediate layer 26 (corresponding to component 7 in FIG. 1) is provided between the carrier ring 23, on the one hand, and the mounting face 27 of the engine block 22, on the other hand. In this embodiment, however, the intermediate layer 26 is not connected by glue or vulcanization with the engine block 22; there is instead, provided an additional carrier ring 28 attached to the engine block 22 by means of screws 29. For inserting and tightening the screws 29 which, with respect to the plane of the drawing FIG. 2, extend in front of and behind the screws 24, there are provided holes 30 in the sound dampening intermediate layer 26. The holes 30 are aligned with the holes in the two carrier rings 23 and 28 and with the predrilled threaded holes provided in the engine block 22. In this embodiment, the holes 30 are of slightly conical configuration in order to facilitate the insertion of the screws 29.

The embodiment according to FIG. 2 provides that the components 23, 26 and 28 can be connected with the engine block 22 from below as a unit, and thereafter the capsule 20 and the oil pan 21 are secured to the engine block 22 by means of the screw connections 24,25. It is to be understood that particularly between the metal components sealing gaskets (not shown in FIG. 2) are provided.

It will be understood that the above description of the present invention is susceptible to various modifications, changes and adaptations, and the same are intended to be comprehended within the meaning and range of equivalents of the appended claims.

What is claimed is:

1. In an internal combustion engine including an engine block and an oil pan sealingly and sound insulatingly secured to one another along substantially horizontally extending mounting faces to constitute a unit and a sound-insulating capsule shrouding the engine block and having a lower terminal zone; the improvement wherein said lower terminal zone of said capsule is constituted by a flange situated between the mounting face of said engine block and the mounting face of said oil pan and further comprising sound dampening mounting means for attaching said lower terminal zone of said capsule to said unit at the height lever of said mounting faces and further wherein said sound dampening mounting means includes (a) at least one sound dampening intermediate layer situated between said flange and said mounting face of said engine block;

(b) a carrier ring positioned between said intermediate layer and said flange; and (c) a plurality of securing bolts extending through aligned openings in said carrier ring, said flange and said mounting face of said oil pan.

2. An internal combustion engine as defined in claim 1, further comprising a first sealing gasket arranged between said flange and said carrier ring and a second sealing gasket arranged between said flange and said mounting sealing face of said oil pan.

3. An internal combustion engine as defined in claim 1, wherein said sound dampening mounting means further comprises an additional carrier ring situated between said intermediate layer and said mounting face of said engine block; aligned passages provided in said intermediate layer and said additional carrier ring, said passages being offset relative to said openings; and a plurality of securing screws extending through said passages for attaching said additional carrier ring to said mounting face of said engine block.

4. An internal combustion engine as defined in claim 1, wherein said intermediate layer is bonded to said carrier ring and said mounting face of said engine block.

5. An internal combustion engine as defined in claim 4, wherein the bond is glue.

6. An internal combustion engine as defined in claim 4, wherein the bond is vulcanization.

* * * * *